US005354212A

United States Patent [19]

Bartle et al.

[11] Patent Number: 5,354,212

[45] Date of Patent: Oct. 11, 1994

[54] MODULAR PLUG AND COVER THEREFOR

[75] Inventors: Alden S. Bartle, Lawrenceville; Michael A. Wise, Duluth, both of Ga.; Masao Sasaki, Kawasaki, Japan; Hironori Ishizuka, Kawasaki, Japan; Hideharu Kajizuka, Kawasaki, Japan

[73] Assignees: OKI Electric Cable Co., Ltd., Kawasaki, Japan; OKI Telecom, Suwanee, Ga.

[21] Appl. No.: 29,566

[22] Filed: Mar. 11, 1993

[51] Int. Cl.[5] ..... H01R 13/58

[52] U.S. Cl. ..... 439/468; 439/459; 439/676

[58] Field of Search ..... 439/456, 457, 459, 460, 439/468, 473, 676

[56] References Cited

U.S. PATENT DOCUMENTS 4,516,825 5/1985 Brennan et al. ..... 439/460 X 5,076,802 12/1991 Colleran et al. ..... 439/468

FOREIGN PATENT DOCUMENTS 3918517 6/1990 Fed. Rep. of Germany ..... 439/460

*Primary Examiner*—Eugene F. Desmond

*Attorney, Agent, or Firm*—Foley & Lardner

[57] ABSTRACT

A modular plug and cover therefor includes a plug body having an insert portion and a rear portion having an indentation. The rear portion receives a cable for connection to the insert portion. A cover for the modular plug is of a substantially rectangular configuration having an open end fitting over the rear portion of the plug body. The cover portion is engageable with the plug body such that an enclosed space is defined between an end of the rear portion of the plug and an opposing inner wall of the cover. The cover is further provided with a tapered projection on an inner surface thereof which corresponds to the location of the indentation and an access opening through which a cable connected to the modular plug is passed. The cover portion may also be engaged with the plug in an inverted state to change the direction in which the cable is oriented.

23 Claims, 11 Drawing Sheets

MODULAR PLUG AND COVER THEREFOR

BACKGROUND OF THE INVENTION

1. Field of The Invention

The present invention relates generally to a modular plug and cover arrangement. Particularly, the present invention relates to a modular plug and cover arrangement which allows cables to be connected in a narrow space or other confined areas and can also protect a cable connected to the modular plug from stress due to excessive bending.

2. Description of The Prior Art

Modular plugs connected to ends of cables for interconnected electronic components are well known, particularly in the field of telecommunications, computers, and the like. In such modular electronic systems, wherein a plurality of components are interconnected by cables, an installation space for arranging the components is often limited. Thus a cable connecting arrangement which allows connection of cables in substantially narrow confines has been required.

Further, at a point where the cable enters the end of the plug, bending of the cable often occurs since the plug is usually inserted into a horizontally oriented socket of a component while the cable hangs vertically. This applies stress to the cable at the bent portion and eventually, delicate internal wires of the cable may break causing disconnection, short circuiting, unreliable connection, or the like. This is particularly true of portable components such as mobile telephones, for example.

FIG. 9 shows an example of a conventional cable cover designed to conserve installation space and reduce such bending stress being applied to a cable in the vicinity of connection to a modular plug. As may be seen from the drawing, the cable cover comprises upper and lower casing portions 1 and 2 defining therebetween an L-shaped passage. The lower casing includes grooves 10 which receive projections 9 formed on each side of a plug body 8. The upper and lower casings 1 and 2 are respectively provided with opposed locking projections 5 mating with opposed grooves 6 having formed therein a locking retainer 6*a* projecting from the inner face of the groove 6. Pegs 3 and opposing bores 4 are also respectively provided on the upper and lower casings 1 and 2 so as to provide correct positioning between the casing portions 1 and 2 when they are joined. The casing body is further provided with a push lever 11 for effecting locking between the modular plug 7 and a socket of a component. A cable 12 is connected to the plug body 9. According to such an arrangement, the cable is suitably protected from bending stress.

However, according to the above described construction, a large number of parts are required and assembly of the plug 7 is high in cost and complexity. Further, molding of the plug body 8 and casing portions 1 and 2 is complex and the parts, in disassembled form, are delicate and prone to breakage. Joining of the parts requires the addition of some step such as ultrasonic welding or applying adhesive which further raises costs.

Further, when the plug is used for extended periods, it may be subjected to heat due to proximity to electronic components etc. Since the structure of the cover and plug body are interlocked, repeated exposure to heat may cause defects in the plug by causing the parts to become deformed, thus shortening an effective life thereof.

Also, the above construction is limited to an L-shaped bend in one direction only and several types must be made depending on which direction a cable 12 is to bend or whether the cable conforms to FCC (Federal Communications Commission) standards or not. The above structure also causes an overall size of the plug 7 to be large. In addition, the placement of the upper casing 1 may interfere with smooth operation of the push lever 11.

Thus it has been required to provide a simple, low cost, flexible arrangement for allowing connection in confined spaces and for protecting a cable in the vicinity of connection to a modular plug.

SUMMARY OF THE INVENTION

It is therefore a principal object of the present invention to overcome the drawbacks of the prior art.

It is a further object of the present invention to provide a modular plug with a cover therefor which assures reliable connection between a cable and a socket into which the modular plug is inserted while protecting the cable from damage due to excessive bending.

It is another object of the invention to provide a modular plug and cover therefor which may be simply and inexpensively manufactured and assembled and which may be installed in a substantially confined space.

In order to accomplish the aforementioned and other objects, a modular plug and cover therefor is provided, comprising: a plug body, the plug body having an insert portion and a rear portion extending outwardly of the insert portion, the rear portion having an indentation formed therein and receiving therein a cable for connection to the insert portion; a cover portion of substantially enclosed configuration having an open end having a shape and size substantially corresponding to that of the rear portion of the plug body, the cover portion being engageable with the plug body such that an enclosed space is defined between an end of the rear portion and an opposing wall of the cover; a tapered projection provided on an inner surface of the cover portion so as to correspond to the location of the indentation; and an access opening receivable of a cable therethrough.

DESCRIPTION OF THE PREFERRED EMBODIMENT

Figure 1:
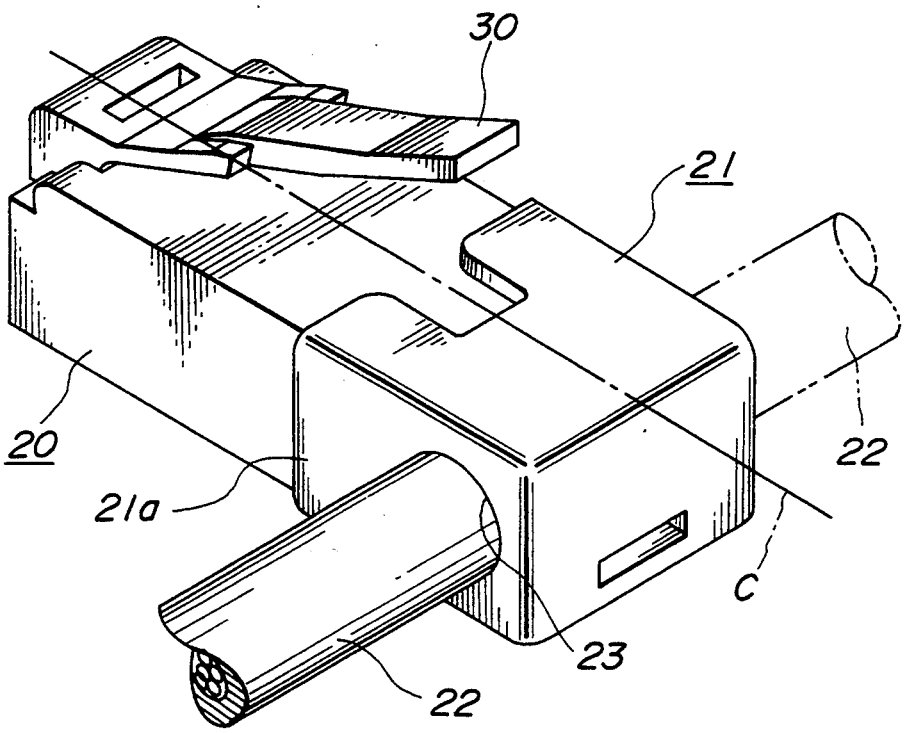
FIG. 1 is a perspective view of a modular plug and cover therefore according to a preferred embodiment of the present invention.
Figure 2A:
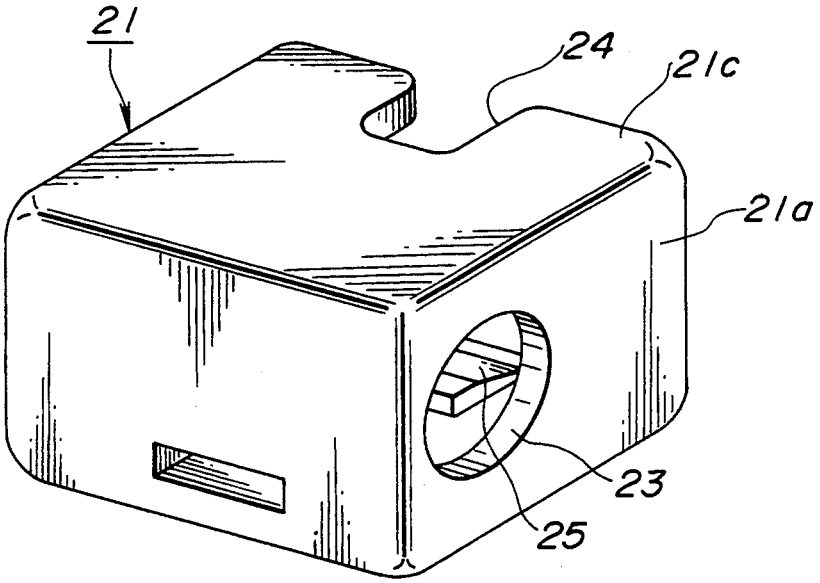
FIGS. 2(A) and (B) show perspective views of the modular plug cover of FIG. 1 from two sides thereof.
Figure 2B:
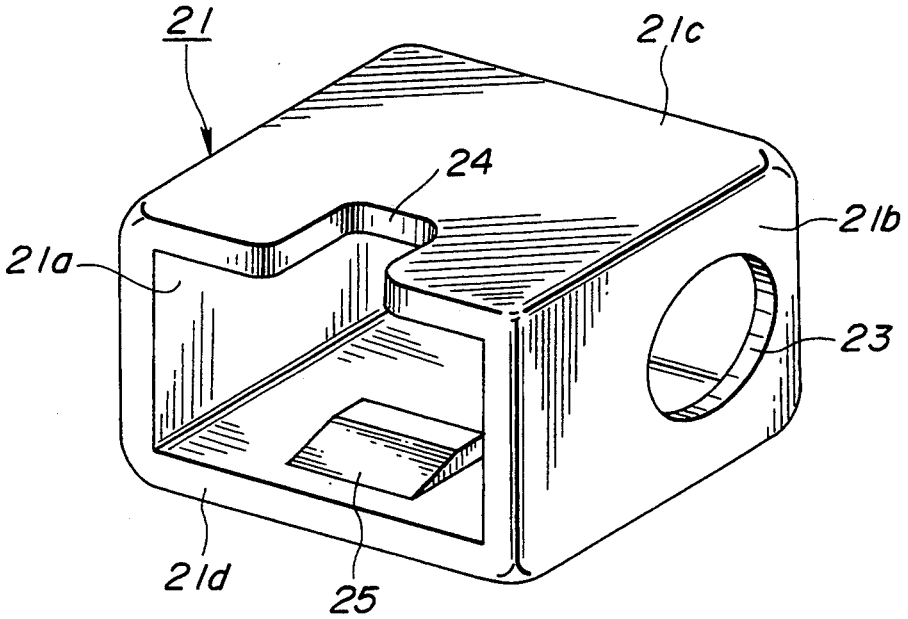
Figure 3:
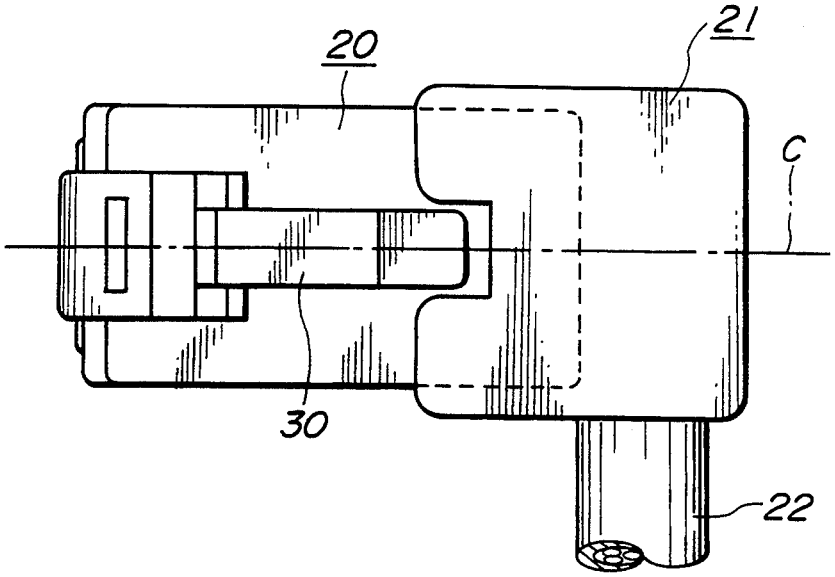
FIGS. 3 is a plan view of the modular plug and cover according to the invention.
Figure 4:
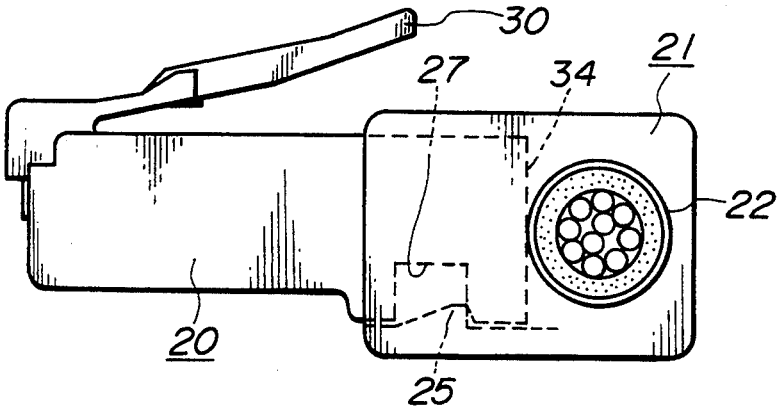
FIG. 4 is a partially cross-sectional side view of the modular plug and cover of FIG. 3.
Figure 5:
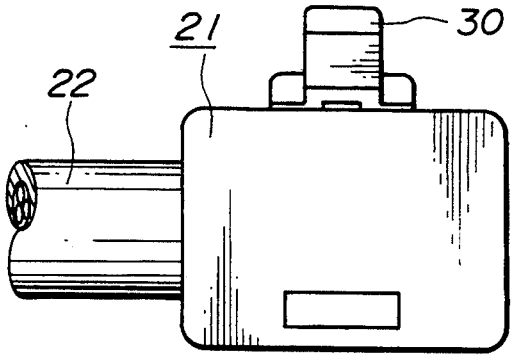
FIG. 5 is a rear view of the modular plug and cover of FIG. 3.
Figure 6:
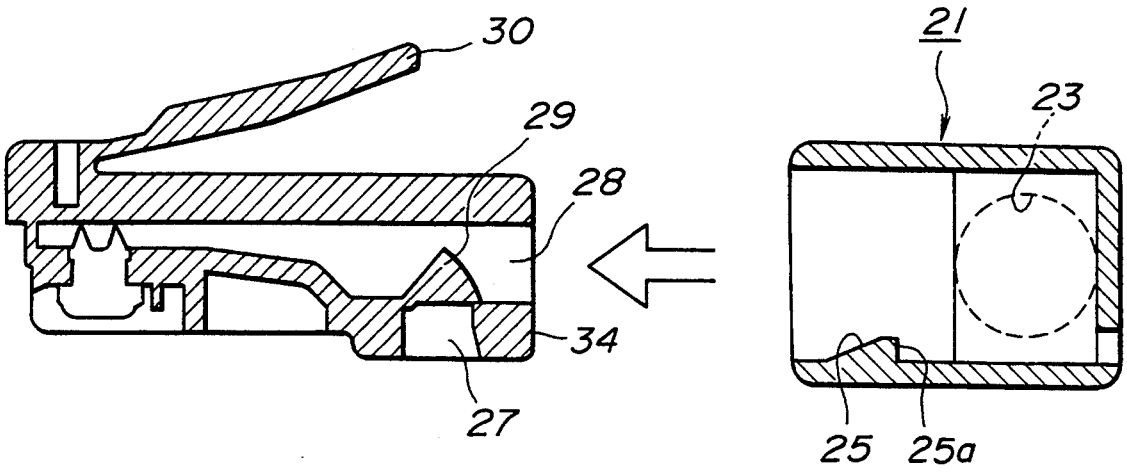
FIG. 6 is a cross-sectional view of the modular plug and cover therefor according to the invention, in a separated state.
Figure 7:
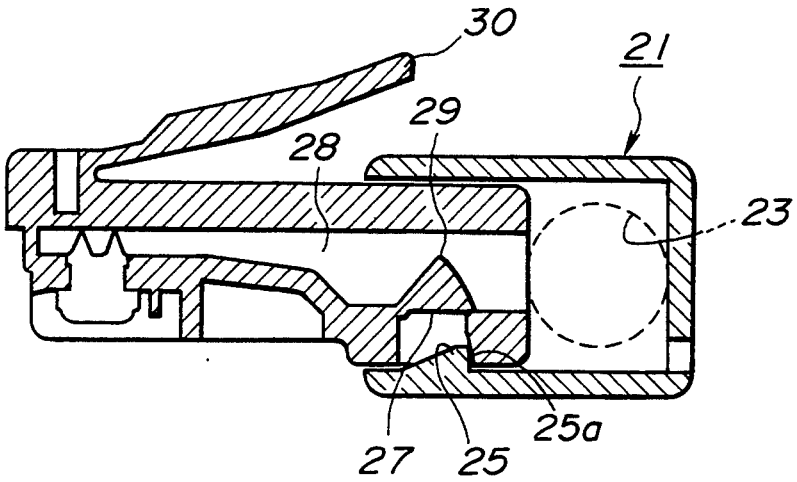
FIG. 7 is a cross-sectional view of the modular plug and cover of FIG. 6 in an engaged state.

Referring now to the drawings, particularly to FIGS. 1, 2(A) and 2(B), a modular plug and cover arrangement according to the invention comprises a plug body 20 and a cable cover 21 covering an end of the plug body 20 to which a cable 22 is introduced. The cable cover 21 is of essentially enclosed configuration, and may for example be rectangular, or box-shaped. An access opening 23 is provided in one wall 21*a* of the cable cover 21 to allow the cable 22 to pass therethrough, alternatively both side walls 21*a* and 21*b* may be provided with the substantially circular access openings 23. Also, as best seen in FIG. 2(B), a tapered projecting portion 25 is formed on one inner wall of the cable cover 21 and having a substantially vertical face oriented in a direction facing away from the plug body 20. Referring to FIG. 4, the plug body 20 has a receiving indentation 27 formed therein at a location so as to engage the tapered projecting portion 25 of the cable cover 21 when the cable cover 21 is engaged with the plug body 20 such that the cable cover 21 is securely locked to the plug body 20.

Referring now to FIGS. 3–7, the interior of the plug body 20 defines a space 28 therein for insertion of the cable 22. A barb, or retainer 29 may be provided in the space for preventing extraction of the cable 22 from the plug body 20. Further, one longitudinal side of the plug body 20 is provided with a lock/release lever 30 in a per se known manner in which the plug body 20 may be inserted into or extracted from a socket (not shown) when the lock/release lever 30 is depressed and the plug body 20 is retained within the socket (not shown) when the lock/release lever 30 is released.

For assembling, an end of the cable 22 is introduced through the access opening 23 on the appropriate side of the cable cover 21, that is, through side walls 21*a* or 21*b*, and then the end of the cable is inserted in to the plug body 20 along the longitudinal axis C (FIGS. 1 and 3) thereof. The cable cover 21 is then pushed over the end 34 of the plug body 20 such that a front face 25*a* of the tapered projection 25 (see FIGS. 6 and 7) engages a side of the receiving indentation 27 thus securely Joining the plug body 20 to the cable cover 21 while supporting the end of the cable 22 in an L-shape configuration.

Figure 8:
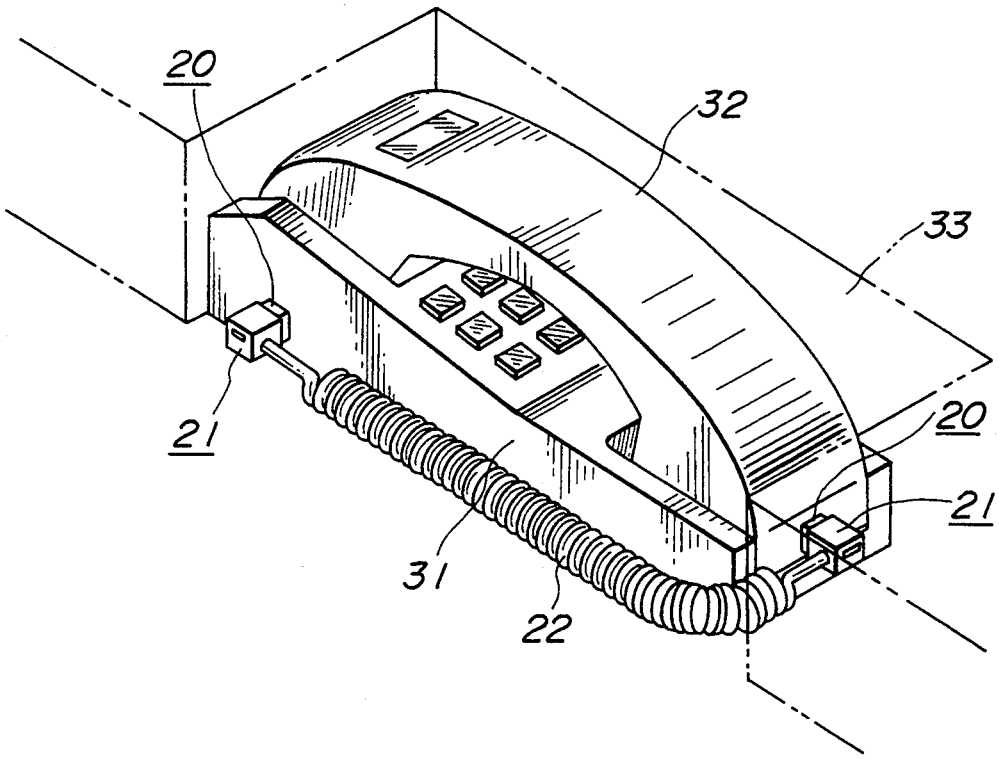
FIG. 8 is a perspective view of a mobile phone installation utilizing modular plug covers according to the invention.
Figure 9:
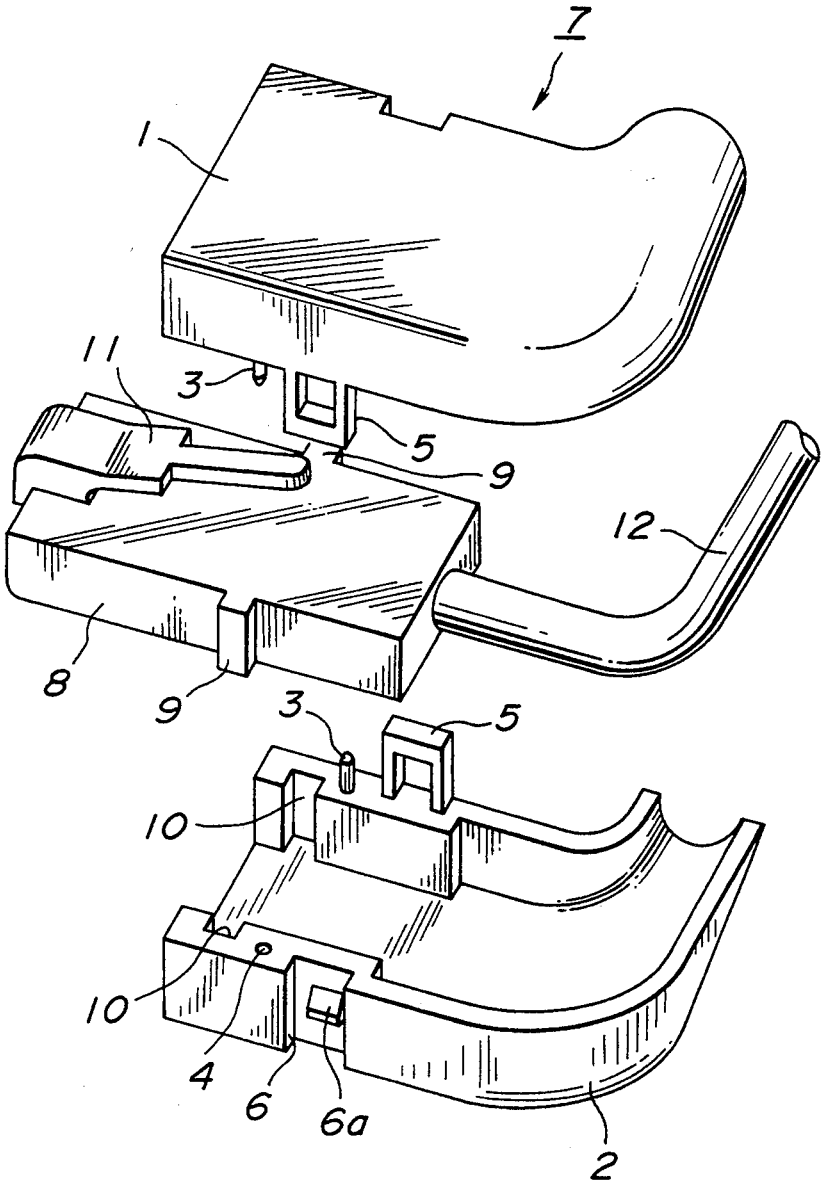
FIG. 9 (PRIOR ART)
FIG. 9 is a perspective view of a conventional cover for a modular plug.

As seen in FIG. 8, such an arrangement is particularly applicable to electronic components such as a mobile phone having a receiver 32 connected to a base 31 which may be mounted on a vehicle panel 33, for example, and which may require a plurality of L-shaped supports oriented in different directions. As seen in the drawing, a plurality of plug bodies 20 and cable covers 21 of exactly the same configuration may be utilized to effect such a connection in compact fashion while providing optimum support for the cable 22.

According to the invention, since the plug body 20 is configured entirely separate of the cable cover 21, the heat resistivity of the modular plug and cover arrangement is enhanced.

Further, according to the present invention, although the access openings 23 are provided in side walls 21*a* and/or 21*b* according to the above-described embodiment, it is also possible that the access openings are provided in upper wall 21*c* and/or the lower wall 21*d* for providing support for upward or downwardly bent cables 22. In this case of course, the location of the projecting portion 25 and the receiving indentation 27 would be relocated accordingly.

Thus, according to the invention, a simple modular plug and cover arrangement is provided which may be assembled in a simple one-step operation without need of welding or adhesives. In addition, the bent portion of the cable 22, in the vicinity where it meets the plug body 20, may be well supported no matter which direction it is to bend. Further, the modular plug and cover arrangment of the invention may be installed in substantially limited space, such as a narrow space between the rear of a component and a wall, for example.

Hereinbelow, a second embodiment of a modular plug and cover arrangement will be described in detail with reference to FIGS. 10–18.

Figure 10:
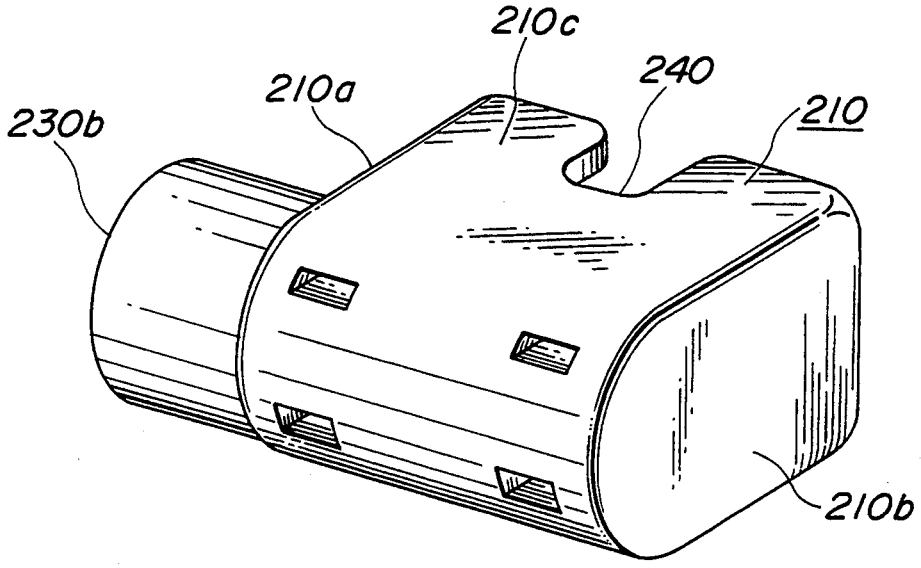
FIG. 10 is a rear perspective view of a second embodiment of a cable cover according to the invention.
Figure 11:
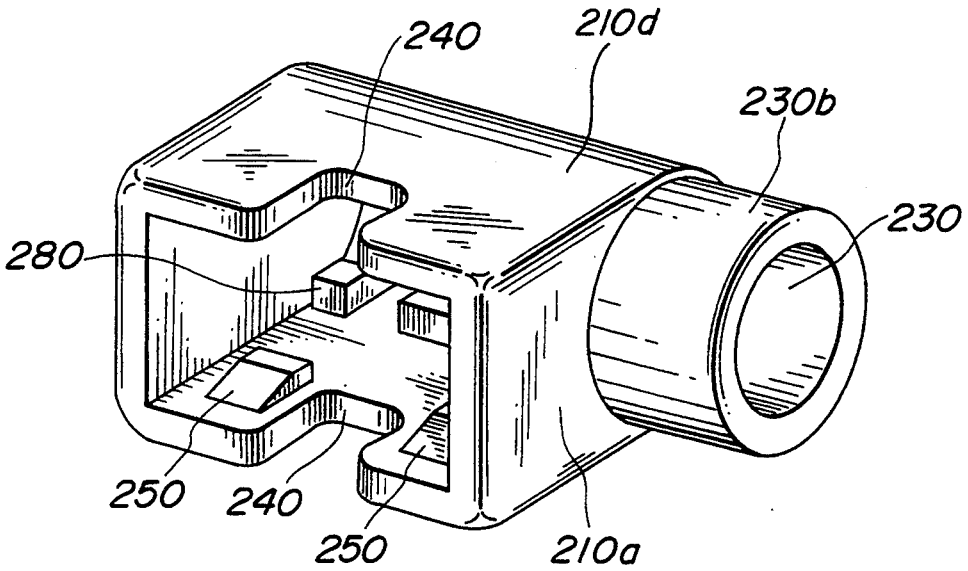
FIG. 11 is a front perspective view of the cable cover of FIG. 10.

First, referring to FIGS. 10 and 11, a perspective view of a cable cover 210 according to the second embodiment is shown. The cable cover 210 comprises a first side 210*a* having an access opening 230 formed therethrough, the access opening 230 may be surrounded by a flange 230*b* for supporting a cable 22 inserted therethrough. A second side 210*b* of the cable cover 210 has no access opening formed therein and upper and lower sides 210*c* and 210*d* respectively may have cut-out portions 240 formed therein. A rear portion of the cable cover is rounded such that the surfaces of the upper and lower sides 210*c* and 210*d* are contiguous. In addition, as seen in FIG. 11, on each side of each of the upper and lower cut-out portions 240, a projecting portion 250 is provided. The projecting portion may be formed with a front face 250*a* similarly to the front face 25*a* of the above-described first embodiment. Thus, four projecting portions 250 are provided according to the present embodiment. Further, at a rear interior portion of the cable cover 210, rib portions 280 may be formed, Front surfaces of which engage a rear surface 34 of the plug body 20 for supporting and correctly positioning the cable cover 210.

Figure 12:
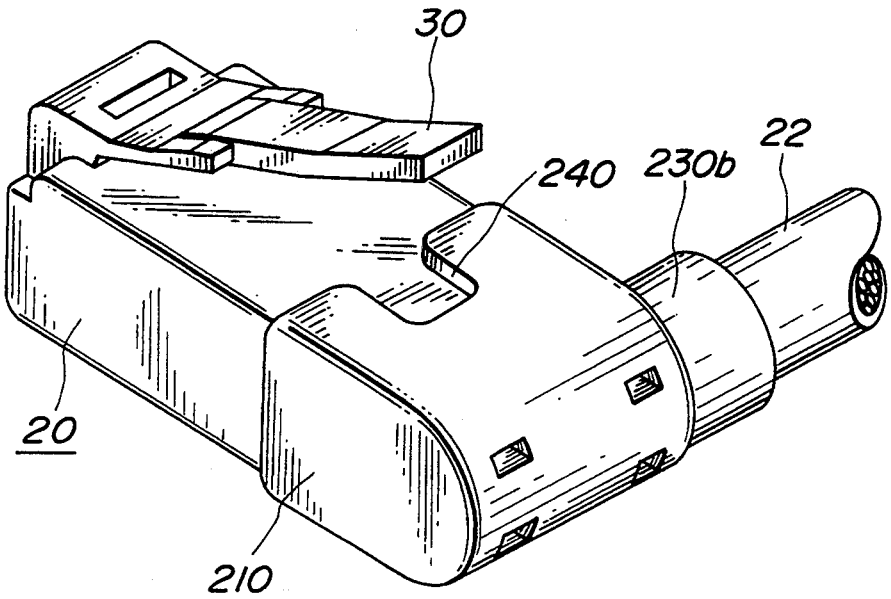
FIG. 12 is a perspective view of a cable cover and plug according to the second embodiment in which the cable is arranged to extend from the right side of the cable cover.
Figure 13:
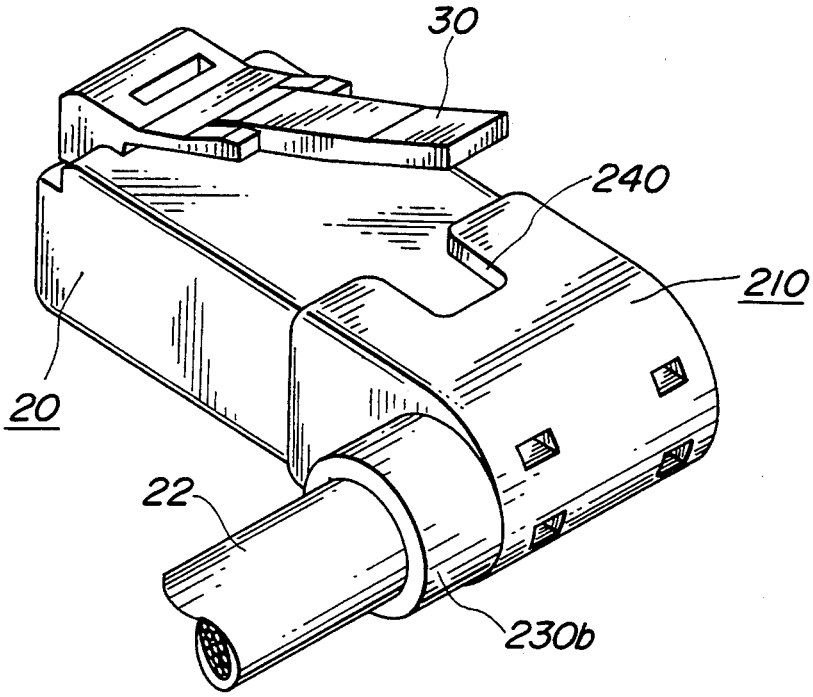
FIG. 13 is a perspective view of a cable cover and plug according to the second embodiment in which the cable is arranged to extend from the left side of the cable cover.

Referring now to FIGS. 12 and 13, the cable cover of the second embodiment in shown engaged with a plug body 20. It will be noted that the cable cover 210 of the present embodiment may be utilized with exactly the same type of modular plug body 20 as utilized by the first embodiment.

However, according to the present embodiment, it is not required to provide an access opening on both sides of the cable cover 210 since the cable cover of the present embodiment may be inverted. That is, the cable cover 210 may be engaged with the plug body 20 in a first, upright state, such as shown in FIG. 12, wherein the cable 22 will project from the right side of the modular plug. Or, as shown in FIG. 13, the cable cover 210 may be engaged with the plug body 20 in an inverted state such that the cable 22 will project from the left side of the plug body 20. Further, according to this embodiment, the flange portion 230*b* serves to support the cable 22 in the vicinity of the access opening 230 no matter which way the cable cover 210 is engaged with the plug body 20.

Figure 14:
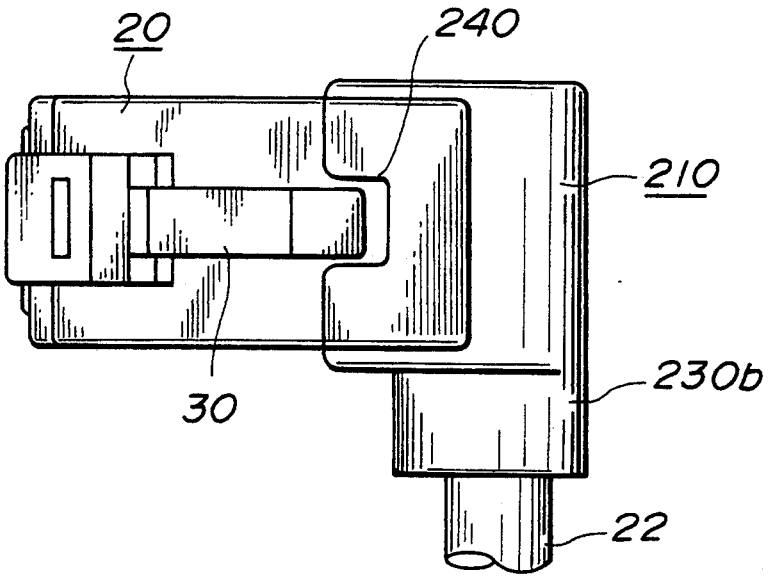
FIG. 14 is a plan view of the cable cover and plug of the second embodiment.
Figure 15:
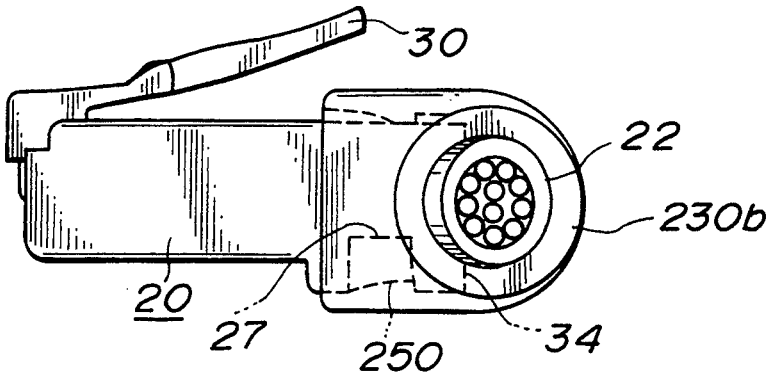
FIG. 15 is a side view of the cable cover and plug of the second embodiment.
Figure 16:
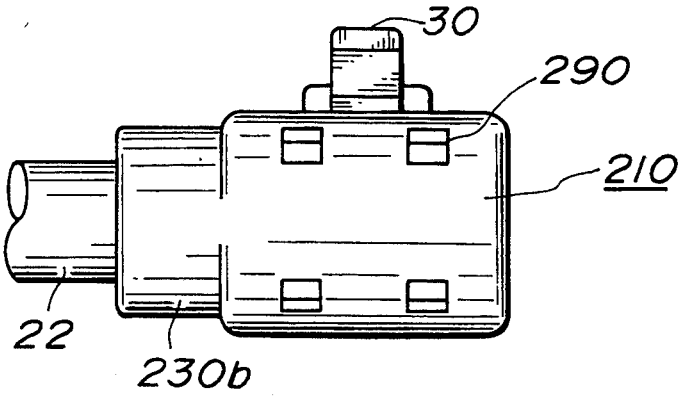
FIG. 16 is a rear view of the cable cover and plug of the second embodiment.

FIGS. 14–16 show plan, side and rear views of the cable cover 210 of the second embodiment as engaged with the plug body 20. As may be seen, the cut-out portions 240 allow for an increased area of movement for the lock/release lever 30, similarly to the first embodiment.

Also, referring to FIG. 15, the interior space of the cable cover may be so formed as to apply squeezing pressure to the cable for firmly holding the same.

FIG. 16 shows a rear view of the plug body 20 and the cable cover 210.

Figure 17:
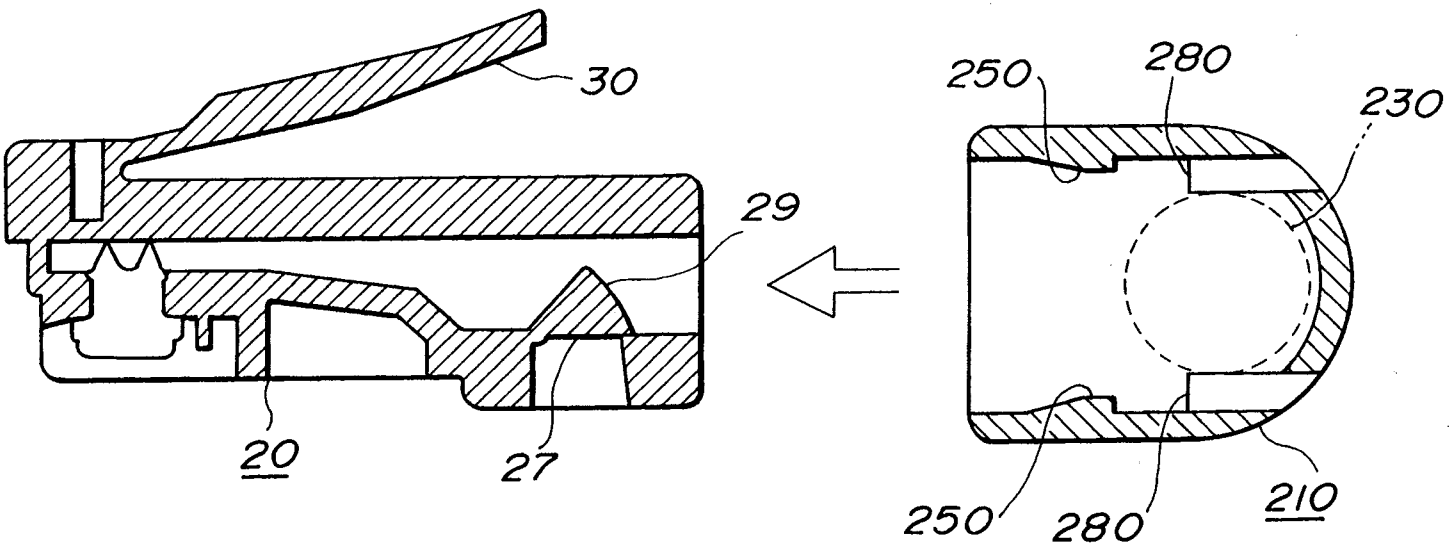
FIG. 17 is a cross-sectional view of the cable cover and plug of the second embodiment in a separated condition.
Figure 18:
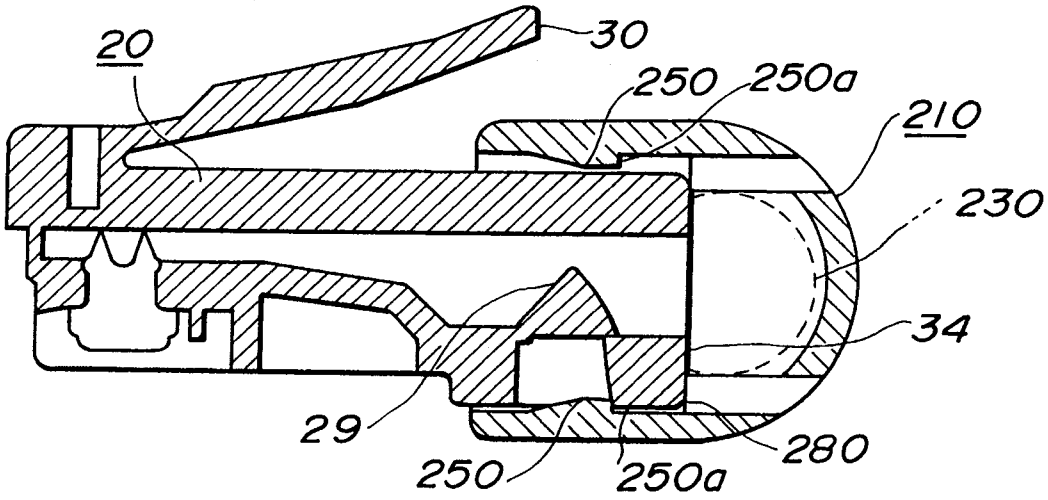
FIG. 18 is a cross-sectional view of the cable cover and plug of the second embodiment in an engaged condition.

As seen in FIGS. 17 and 18, the cable cover of the second embodiment is engageable with a plug body 20 identical to that of the above-described first embodiment. That is, as seen in FIG. 17, the plug body includes a barb, or retainer 29 for anchoring the cable 22 within the plug body 20 and an indentation 27 for engaging a lower two of the four projecting portions 250.

Referring to FIG. 18 it can be seen that the front faces 250*a* of the two lower projecting portions 250 engage the facing side of the indentation 27 similarly to the arrangement of the first embodiment. Also, the rib portions 280 firmly contact the rear surface 34 of the plug body 20 so as to correctly position the cable cover 210.

However, it is noted that the cable cover 210 of the present embodiment is not limited to the above structure but, alternatively, the upper and lower cut-out portions 240 may be omitted and a single elongate projecting portion 250 may be provided on upper and lower inner walls of the cable cover 210, one of which engages the indentation 27 according to an engaged orientation of the cable cover 210. Alternatively, the cable cover 210 of the second embodiment may be utilized with a modified plug body having upper and lower indentations 27 such that all of the projecting portions 250 provided on the cable cover 210 are engaged.

Thus according to the present invention, a cable connection may be suitably accomplished even in very limited or narrow confines and a cable connected to a modular plug is securely supported.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A modular plug and cover arrangement, comprising:

a plug body, said plug body having an insert portion and a rear portion extending outwardly of said insert portion, said rear portion receiving therein a cable for connection to said insert portion;

a cover portion of substantially enclosed configuration having an open end engageable with said plug body such that an enclosed space having a dimension substantially equal to a diameter of said cable is defined between an end of said rear portion and an opposing wall of said cover portion;

means for retaining said cover portion on said plug body; and an access opening in said cover portion and receivable of a cable therethrough.

2. A modular plug and cover arrangement as set forth in claim 1, wherein said plug body further includes a push lever for effecting locking of said plug and releasing thereof from a socket accepting said plug.

3. A modular plug and cover arrangement as set forth in claim 2, wherein a cut-out is provided in one surface of the cover portion in the vicinity of said push lever provided on the plug body.

4. A modular plug and cover arrangement as set forth in claim 3, wherein upper and lower sides of said cover portion each include cut-out portions, tapered projections being provided on each side of each cut-out portion.

5. A modular plug and cover arrangement as set forth in claim 1, wherein said cable access opening is provided in two sides of said cover portion.

6. A modular plug and cover arrangement as set forth in claim 5, wherein said two sides oppose each other.

7. A modular plug and cover arrangement as set forth in claim 1, wherein a diameter of said access opening is equal to a diameter of a cable connected to said plug body.

8. A modular plug and cover arrangement as set forth in claim 1, wherein a shape and dimension of said access opening is equal to a shape and dimension of a cable connected to said plug body.

9. A modular plug and cover arrangement as set forth in claim 1, wherein said cover portion has a plurality of walls, an access opening being provided in each wall of said cover portion.

10. A modular plug and cover arrangement as set forth in claim 1, wherein said cover portion is substantially rectangular.

11. A modular plug and cover arrangement as set forth in claim 10, wherein opposing side walls of said cover portion are provided with access openings.

12. A modular plug and cover arrangement as set forth in claim 1, wherein said cover portion is made of synthetic resin.

13. A modular plug and cover arrangement as set forth in claim 1, wherein said cover portion is made of rubber.

14. A modular plug and cover arrangement as set forth in claim 1, wherein said means for retaining comprises a tapered projection having a substantially vertical face oriented in a direction facing away from the plug body and engageable with a substantially vertical face of an indentation formed in said plug body.

15. A modular plug and cover arrangement as set forth in claim 14, further comprising a plurality of said tapered projections wherein said tapered projections are provided on upper and lower inner surfaces of said cover.

16. A modular plug and cover arrangement as set forth in claim 1, wherein a space is defined within said plug body for accepting said cable along a predetermined axis, a retaining member being provided in said space such that extraction of said cable is prevented.

17. A modular plug and cover arrangement as set forth in claim 16, wherein said predetermined axis is perpendicular to a width direction of said cover portion.

18. A modular plug and cover arrangement as set forth in claim 1, wherein a rear surface of said cover portion is semicircular in shape.

19. A modular plug and cover arrangement as set forth in claim 1, wherein said cover portion is engageable with said plug body in an upright position as well as in an inverted position such that the orientation of said access opening is reversed.

20. A modular plug and cover arrangement as set forth in claim 1, wherein said means for retaining comprises tapered projections having substantially vertical faces oriented in directions facing away from the plug body and indentations having substantially vertical faces and formed on upper and lower sides of said plug body wherein said indentations are for engaging said tapered projections when said cover portion is inverted for engagement with said plug body.

21. A modular plug and cover arrangement as set forth in claim 1, further including a flange portion around said access opening to support said cable at a point where said cable enters said access opening.

22. A modular plug and cover arrangement as set forth in claim 1, wherein rib portions are formed at an inner rear portion of said cover portion to brace said cover portion against a rear surface of said plug body.

23. A modular plug and cover arrangement as set forth in claim 1, wherein an axial direction of said access opening is perpendicular to an axial direction of said plug body.

* * * * *